US010011384B2

(12) United States Patent
Albeniz Garcia-Falces et al.

(10) Patent No.: US 10,011,384 B2
(45) Date of Patent: Jul. 3, 2018

(54) LABELLING MACHINE

(71) Applicant: ALBENIZ ETIQUETAJE INDUSTRIAL, S.L., Pamplona (ES)

(72) Inventors: Eduardo Albeniz Garcia-Falces, Pamplona (ES); Josu Lorente Roda, Pamplona (ES)

(73) Assignee: ALBENIZ ETIQUETAJE INDUSTRIAL, S.L., Pamplona (Navarra) (ES)

( * ) Notice: Subject to any disclaimer, the term of this patent is extended or adjusted under 35 U.S.C. 154(b) by 45 days.

(21) Appl. No.: 15/032,187

(22) PCT Filed: Nov. 13, 2014

(86) PCT No.: PCT/ES2014/070839

§ 371 (c)(1),
(2) Date: Apr. 26, 2016

(87) PCT Pub. No.: WO2015/071519

PCT Pub. Date: May 21, 2015

(65) Prior Publication Data

US 2016/0264282 A1 Sep. 15, 2016

(30) Foreign Application Priority Data

Nov. 15, 2013 (ES) ..... 201331664

(51) Int. Cl.
*B65C 9/18* (2006.01)
*B65C 1/02* (2006.01)
(Continued)

(52) U.S. Cl.
CPC ..... *B65C 9/1876* (2013.01); *B65C 1/021* (2013.01); *B65C 9/1815* (2013.01); *B65C 9/26* (2013.01);
(Continued)

(58) Field of Classification Search
CPC ..... B65C 9/00; B65C 1/021; B65C 9/1815; B65C 9/30; B65C 9/26; B65C 9/08;
(Continued)

(56) References Cited

U.S. PATENT DOCUMENTS 9,701,432 B2 * 7/2017 Bernhard ..... B65C 9/08
2013/0340918 A1 * 12/2013 Dods ..... B65C 1/021 156/73.6

FOREIGN PATENT DOCUMENTS

DE 3702595 A1 * 8/1988 ..... B65C 9/10
DE 102009020269 A1 11/2010
(Continued)

OTHER PUBLICATIONS

Machine translation of DE3702595, Aug. 1988.*
(Continued)

*Primary Examiner* — Philip C Tucker
*Assistant Examiner* — Jimmy R Smith, Jr.
(74) *Attorney, Agent, or Firm* — Lucas & Mercanti, LLP

(57) ABSTRACT

A labelling machine, comprising a series of label dispensers (2) arranged in a column, a label application device (3) and transportation means for transporting labels from the dispensers (2) to the application device (3), these transportation means being formed by a first transportation module (4), which may be moved vertically, and a second transportation module (5) that tips via a vertical axis.

5 Claims, 4 Drawing Sheets

(51) Int. Cl.
*B65C 9/26* (2006.01)
*B65C 9/08* (2006.01)
*B65C 9/00* (2006.01)

(52) U.S. Cl.
CPC ..... *B65C 9/00* (2013.01); *B65C 9/08* (2013.01); *B65C 9/183* (2013.01); *B65C 2009/005* (2013.01); *B65C 2009/0053* (2013.01)

(58) Field of Classification Search
CPC ..... B65C 9/10; B65C 2009/005; B65C 9/34; B65C 9/105; B65C 2009/0081; B65C 9/0062; B65C 1/028; B65C 2009/0021; B65C 2009/0053; B65C 9/18; B65C 9/183; B65C 9/1892; B65C 2009/0084; B65C 9/1819; B65C 9/1876; B65C 9/188
USPC ..... 156/538
See application file for complete search history.

(56) References Cited

FOREIGN PATENT DOCUMENTS

| | | | |
|---|---|---|---|
| DE | 102012002250 | A1 | 8/2013 |
| WO | 2007059204 | A2 | 5/2007 |
| WO | 2008135079 | A1 | 11/2008 |

OTHER PUBLICATIONS

Etiquette Labels Ltd: PRX Robot IRB Print Apply Labelling Machine and Label Applicator; Jul. 14, 2011; XP054975540; URL: https://www.youtube.com/watch?v=Bd3-6m SOOak.

International Search Report and Written Opinion dated Mar. 2, 2015 for PCT/ES2014/070839.

* cited by examiner

LABELLING MACHINE

CROSS REFERENCE TO RELATED APPLICATION

This Application is a 371 of PCT/ES2014/070839 filed on Nov. 13, 2014 which, in turn, claimed the priority of Spanish Patent Application No. P201331664 filed on Nov. 15, 2013, both applications are incorporated herein by reference.

FIELD OF THE INVENTION

The present invention relates to a machine for applying or printing and applying labels, which falls within the field of industrial labelling and may be used to label products in different industrial and commercial sectors, for example in the manufacture of tyres and car parts and in pharmaceutical laboratories, etc.

STATE OF THE ART

Currently, a variety of devices exist, which make it possible to apply or to print and apply labels to various products moving along a production line in real time, by combining the application height from one product to the next, in accordance with the height of each product.

In these labelling processes, each product must be identified before it is labelled. However, in some production lines, it may take too long for the label application cycle to be carried out using current machines (for printing and applying labels at a certain height), thereby reducing clients' production capacity.

Another drawback of these systems is that they make it necessary for the machine to be stopped each time the labels must be repositioned, thereby reducing production considerably.

Finally, it must be noted that current machines used to apply or print and apply labels only make it possible to work with one label format at a time.

Document DE102012002250 discloses an applicator device for applying wrapping labels to packages, having a transverse transport device (19) which is configured for transporting a label, which is first of all dispensed by a label dispenser, in particular a label printer (11), in the vertical direction into an intermediate position, from the intermediate position transversely with respect to the vertical into an application position, in which the label can be received by a packaging which is running through.

DESCRIPTION OF THE INVENTION

The present invention aims to resolve the problems set out above, by means of a labelling machine that makes it possible to apply and/or print and apply labels of different formats in real time, without it being necessary to carry out operations in the machine that require it to be stopped.

Another aim of the invention is to make it possible to apply labels at different heights, whilst keeping the machine in continuous operation, without having to stop it.

A further aim of the invention constitutes making it possible to change the consumer good in question, without having to stop the machine.

Ultimately, the machine will make it possible to increase productivity in labelling operations, given the advantages set out above.

The machine object of the invention includes a series of application or printing and application systems, which dispense labels and are of the variety known about in the state of the art. They are arranged in a column within a case and a label application device is separated from the label dispensers, which may be of any kind, for example a roller, palette knife or brush, etc.

In the machine object of the invention, label transportation means are arranged between the label dispensers and label application device. These means comprise two transportation modules; one first mobile transportation module, which may be moved vertically in positions that coincide with those occupied by the label dispensers, in order to receive the label supplied by said label dispenser in each position and; a second transportation module, which may not be moved vertically but which is responsible for applying labels by means of a cylinder that causes the application module to rotate, moving it closer to the object to which a label is to be applied, it being possible for the first mobile module to be placed opposite the second fixed module, in order to transfer labels from said first module to said second module.

The first module is mounted to a guide or vertical linear driver, in order to be moved. This guide includes pulling means, responsible for moving said module between positions that may be located opposite the label dispensers and the second fixed module.

The label application device, no matter how it is constructed, is preferably mounted to the second fixed transportation module, at the output of the same.

The second fixed module and the label application device are preferably higher than the first mobile module and the labels, in order to facilitate the application of the same at different heights, without it being necessary to lift or lower the second module.

Both the first and second transportation modules are formed by continuous strips or cords, which are close to and are also parallel to one another. During their trajectory, they define a straight stretch, which forms a flat transportation surface in the set of strips or cords. Each one of the modules furthermore comprises a suction-based vacuum system, by way of a number of ventilators inside the strips or cords, in the area defined by the flat transportation surface, by means of which the labels are pressed against said flat surface, thereby ensuring they are pulled by the cords or belts that form the transportation system.

The second transportation module is mounted to a fixed support by means of a vertical axis, upon which it may tip between a label reception position, in order to receive labels from the first module backed against said first module, and a delivery or labelling position, in which the label application device is backed against the product to be labelled.

In the machine object of the invention, the modules that constitute the transportation means for transporting labels are arranged after the pieces of labelling equipment (printers or labelling print-heads), which are responsible for dispensing the labels printed. From the pieces of labelling equipment, the first mobile module transports the label from the piece of dispensing equipment (the printer or print-head) to the second transportation module, which is responsible for transporting the label to the label application device, in the form or a roller, palette knife or brush, etc., installed at the end of the second module. This label application device serves to put the label in contact with the product to be labelled and to apply said label to the same.

As already indicated, the first mobile module is mounted to a vertical linear axis, which enables it to collect the labels from any of the label dispensers arranged in a column and place itself opposite the second transportation module, at the required labelling height, in order to transfer the label, to be applied to a certain product, to the same.

When the product to be labelled reaches the height of the label application device, the second transportation module will tip around the vertical axis, putting the label into contact with the product via the roller or brush, etc., which constitute the label application device, thus finalising the labelling process.

As the second transportation module applies the label, the second mobile module may begin to collect the next label. If the system only works with one piece of dispensing equipment, this will reduce the time the labelling cycle takes to complete, owing to this overlap in time. If more than one piece of vertical dispensing equipment is mounted, in addition to the previous advantage, the machine will be able to continue working as the supplies consumed by the machine (labels and ribbon) are being changed. It will also be able to work with different label formats at the same time.

Ultimately, the machine object of the invention enables the time between processes in the two modules to be overlapped and furthermore, it is not necessary for the machine to be stopped as the supplies it consumes are changed. This machine therefore gives rise to high productivity and makes it possible to apply labels with different formats (as regards size and design) at the same time.

BRIEF DESCRIPTION OF THE DRAWINGS

The drawings attached illustrate a possible, non-limiting embodiment of a labelling machine built in accordance with the invention, wherein.

DETAILED DESCRIPTION OF ONE EMBODIMENT OF THE INVENTION

Figure 1:
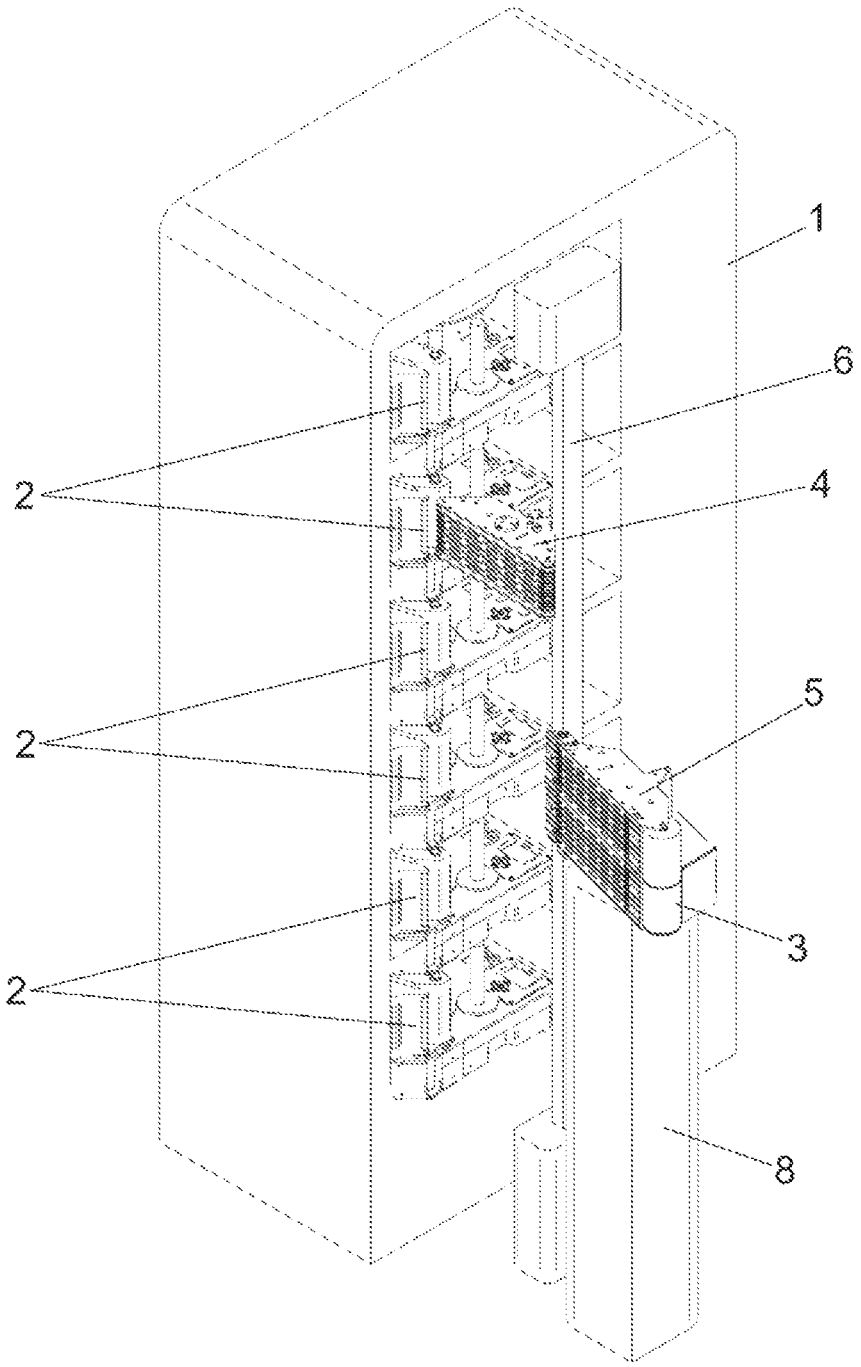
FIG. 1 is a perspective view of a machine, built according to the invention.

FIG. 1 represents a labelling machine, comprising a case 1 in which a series of label dispensers 2 are housed, arranged in a column and located one on top of the other, at different levels, these label dispensers being built in a known manner.

The machine shown in FIG. 1 also comprises a label application device 3, which may be of the roller, brush or palette knife variety, etc. This label application device 3 is located at a distance from the column of label dispensers 2.

Label transportation means are located between the column of label dispensers 2 and the label application device 3. They are responsible for transporting the labels supplied by one of the label dispensers 2 to the label application device 3.

The transportation means mentioned comprise a first transportation module 4, which may be moved vertically between positions that coincide with those occupied by the label dispensers 2 and a second transportation module 5, the height of which is fixed in position.

The first transportation module 4 is mounted to a guide or vertical applicator 6, with means for moving this first module 4 vertically, in order to locate it in a position opposite any one of the label dispensers 2, in order to adjust the labels printed and provided by the label dispenser to each position.

Figure 2:
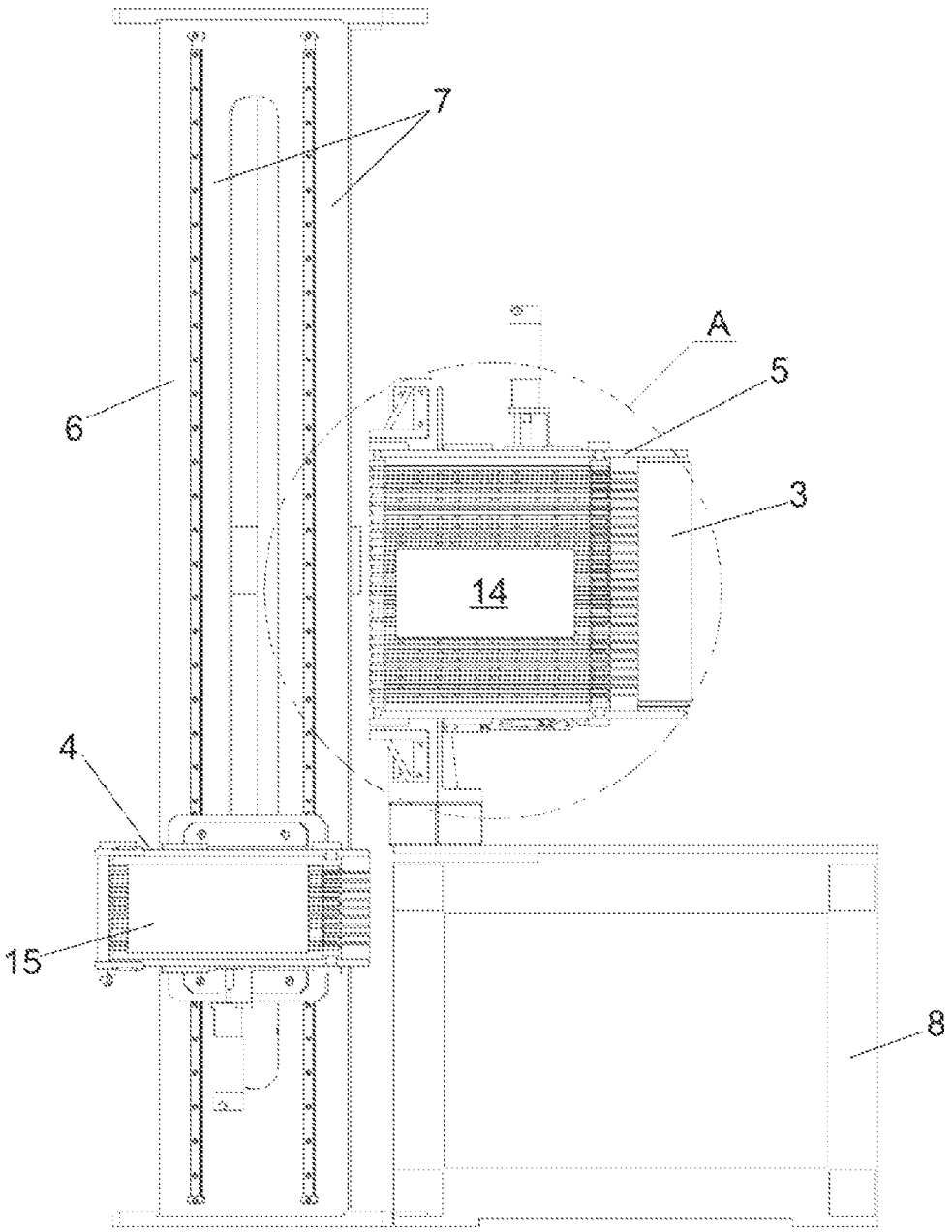
FIG. 2 is a front elevation view of the transportation means, located between the label dispensers and the label application device.

FIG. 2 shows the first transportation module 4 mounted to the vertical guide 6, which includes an elevation mechanism 7, for example of the chain variety.

The second transportation module 5 is mounted to a base 8 via a vertical axis 9, upon which it may tip as a result of being driven by a hydraulic cylinder 10.

Figure 3:
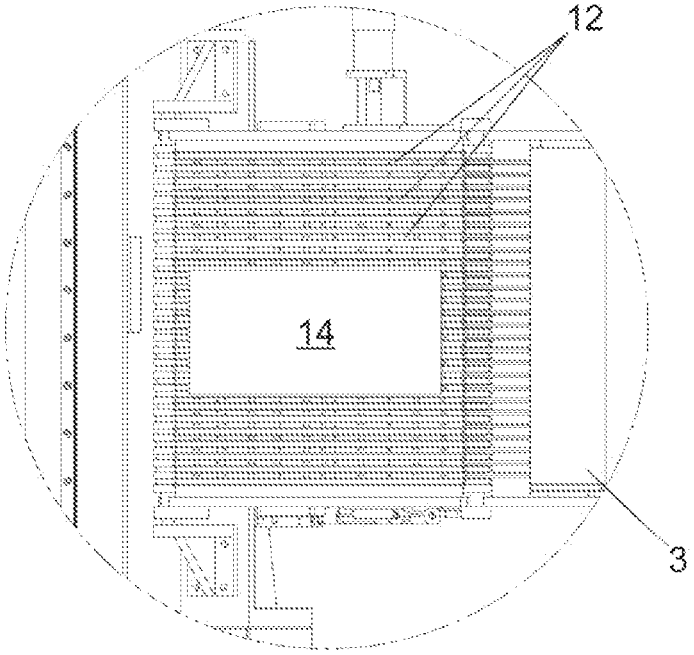
FIG. 3 is a blown-up representation of detail A shown in FIG. 2.

The transportation module 3 shown in greater detail in FIG. 3 is formed by a series of continuous cords or belts, which are mounted between vertical traction rollers and change direction. These cords or belts define a flat plane along their trajectory, as shown in a front view in FIG. 3, which constitutes the label transportation surface. This module furthermore includes means 13 for creating a vacuum system within the module, which will create suction from the outside in, via the cords or belts 12, which thereby gives rise to the labels 14 that reach the transportation surface of the module being driven or pressed against said cords or belts.

The first transportation module 4 is built in the same way as described for the second module 5. In other words, it is a transportation system formed by continuous cords or belts, which define a flat platform that serves as a transportation surface for the labels 15, which also includes a vacuum system, for example made from ventilators, similar to that of the second transportation module 5.

Figure 4:
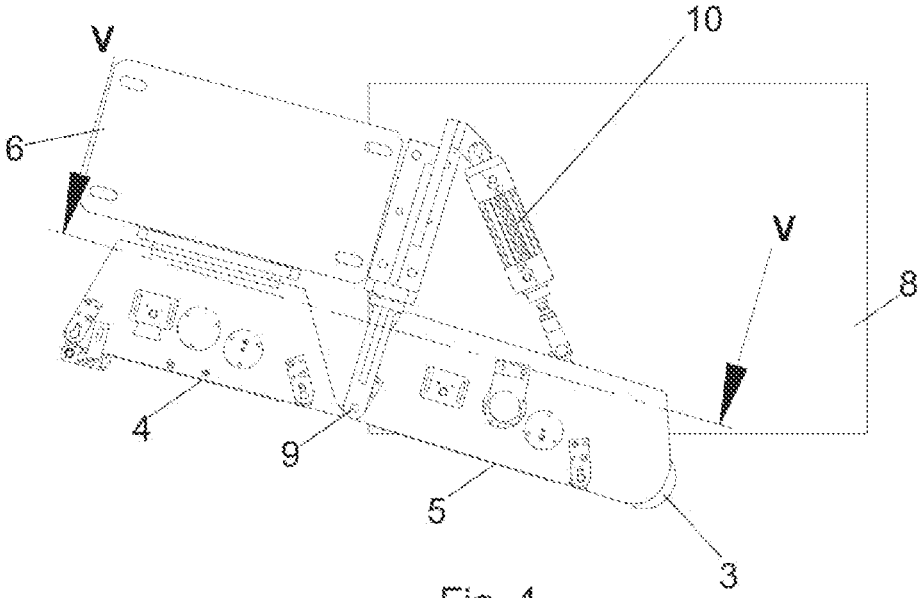
FIG. 4 is a detailed representation of the transportation means shown in FIG. 2.
Figure 5:
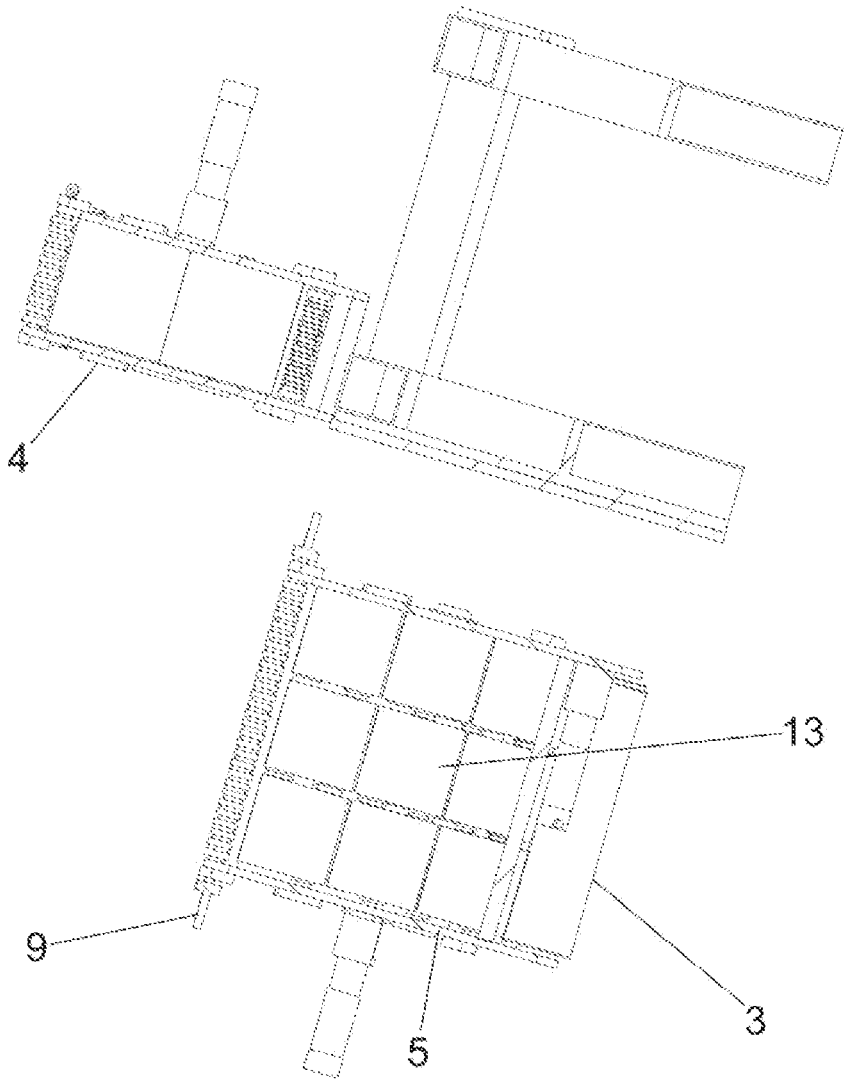
FIG. 5 is a cross-section of the transportation means, according to the cut line V-V shown in FIG. 4.

With the construction described, when one wishes to collect the label provided by a certain label dispenser 2, the first transportation module 4 is moved along the guide 6 until it is located at the same height as the label dispenser, the flat transportation surface being defined by the continuous cords or belts that extend the output of the label dispenser, as shown in FIG. 1. The first transportation module 4 is then moved along the guide 6, until it reaches the height of the second transportation module 5, this second module occupying the position shown in FIG. 4, in which the flat transportation surface of the same remains in a position considerably coplanar to the flat transportation surface of the first module 4. In this location, the label may be moved from the first transportation module 4 to the second transportation module 5. As of this moment, the second transportation module 5 will tip around the vertical axis 9, secured by the cylinder 10, until the label application device 3 is opposite and approximately tangent to the surface of the object or article to be labelled.

As can be seen in FIG. 2, the second transportation module 5 is higher than the labels 14, in order to facilitate the application thereof at different heights, without the module having to be raised and lowered. When the project to be labelled reaches the height of the label application device 3, this second transportation module will tip, in order to put the label in contact with the product, via the application device 3, thereby finalising the labelling process.

As the second transportation module 5 applies the label, the first transportation module 4 may collect the label from the other label dispenser 2.

In addition to the time overlap between the actions of transportation modules 4 and 5, various label dispensers 2 are mounted in a column, which enables the machine to continue working as the supplies consumed by the machine are changed, in addition to making it possible for the machine to work with different label formats at the same time.

As the label dispensing machine 2 operates, information on the arrival of a product is received and this information is then managed, printing any variations shown on the label if necessary. The first transportation module 1 then selects and dispenses the label needed, in order to transfer it to the correct height, at which the second transportation module 5 and the label application device, responsible for transferring the label to the product in question, are located.

The construction of the machine, object of the invention, described, makes it possible:

To increase productivity in those label application or printing and application processes carried out on products at different heights.

In turn, this makes it possible to use different label formats.

Thereby achieving non-stop manufacturing.

As a result, the time the production cycle itself takes to carry out is not increased.

The invention claimed is:

1. A labelling machine comprising:

a housing comprising a plurality of label dispensers for dispensing printed and/or pre-printed labels, the plurality of label dispensers arranged in a column and located one on top of the other, at different levels, inside the housing;

a base outside the housing;

a vertical guide or vertical driver between the housing and the base; and transportation means for transporting labels, the transportation means comprising:

a vertically movable first transportation module, mounted to the vertical guide or vertical driver and configured to receive the labels printed by the plurality of label dispensers; and a vertically fixed second transportation module, mounted to the base, comprising a label application device and configured to supply the label application device with labels obtained from the vertically movable first transportation module;

wherein the vertically movable first transportation module is located opposite to the vertically fixed second transportation module, in order to transfer labels from the vertically movable first transportation module to the vertically fixed second transportation module, wherein the plurality of label dispensers are arranged in a column and located one on top of the other, at different heights, and the first transportation module may be moved vertically between positions that coincide with those occupied by the label dispensers, and wherein the vertically fixed second transportation module is mounted to the base by means of a vertical tip axis.

2. The machine according to claim 1, wherein the vertically movable first transportation module mounted to the guide or vertical driver is provided with pulling means capable of moving said module between positions opposite the label dispensers and to the vertically fixed second transportation module.

3. The machine according to claim 1, wherein the label application device is mounted to the vertically fixed second transportation module, at the output of the same.

4. The machine according to claim 1, wherein the vertically fixed second transportation module and the label application device are located higher than the vertically movable first transportation module, thereby positioning said vertically movable first transportation module opposite the vertically fixed second transportation module, at different heights thereof.

5. The machine according to claim 1, wherein the vertically movable first transportation module and vertically fixed second transportation module are formed by means of continuous cords or belts, which may be moved longitudinally and which are located near and parallel to one another, defining a flat transportation surface, inside which a vacuum system is arranged, which is responsible for pressing the labels against the flat transportation surface.

* * * * *